US008794559B1

(12) United States Patent
Olliges et al.

(10) Patent No.: US 8,794,559 B1
(45) Date of Patent: Aug. 5, 2014

(54) SOLID STATE STORAGE DEVICE CRUSHER

(71) Applicant: Phiston Technologies, Inc., Miami, FL (US)

(72) Inventors: William Olliges, Palm City, FL (US); M. Ali Ebadian, Miami, FL (US)

(73) Assignee: Phiston Technologies, Inc., Miami, FL (US)

( * ) Notice: Subject to any disclaimer, the term of this patent is extended or adjusted under 35 U.S.C. 154(b) by 0 days.

(21) Appl. No.: 14/087,654

(22) Filed: Nov. 22, 2013

(51) Int. Cl.
*B02C 25/00* (2006.01)

(52) U.S. Cl.
USPC ..... 241/243

(58) Field of Classification Search
USPC ..... 241/262, 263; 100/94–96, 98 A, 902
See application file for complete search history.

(56) References Cited

U.S. PATENT DOCUMENTS

| | | | | |
|---|---|---|---|---|
| 4,507 | A * | 5/1846 | Clark | 241/263 |
| 4,272,032 | A * | 6/1981 | Hellberg | 241/263 |
| 4,291,618 | A * | 9/1981 | Heiser et al. | 100/35 |
| 7,861,956 | B2 * | 1/2011 | Hiller, Sr. | 241/30 |
| 7,975,950 | B2 * | 7/2011 | Ebadian et al. | 241/263 |
| 2010/0276524 | A1 | 11/2010 | Ebadian et al. | |

* cited by examiner

*Primary Examiner* — Faye Francis
(74) *Attorney, Agent, or Firm* — McHale & Slavin, P.A.

(57) ABSTRACT

An apparatus for destroying memory devices like hard drives by compression and electrical current to destroy the memory media inside the memory device. The apparatus includes a pair of opposed compression plates, at least one plate is grounded while the other plate charged with 5 to 100 volts of electricity being movable toward the other by a linear motion force. An automatic stripper is provided to strip any memory device retained on the compression plates.

11 Claims, 9 Drawing Sheets

SOLID STATE STORAGE DEVICE CRUSHER

RELATED PRIOR ART

This application is related to U.S. Pat. No. 7,975,950 issued Jul. 12, 2011.

FIELD OF INVENTION

The invention relates to a device for destroying electronic memory media devices.

BACKGROUND OF THE INVENTION

The finding of discarded electronic storage media still containing data has recently made news. People believed the data had been deleted when a data storage device had been removed and discarded. Computers with information still in the memory have been sold or discarded. Some of these devices contained classified government information and some contained highly sensitive and valuable personal data. The high profile media coverage of some of these happenings and the potential liability and losses from such disclosures have made it more important than ever to provide extra security against such inadvertent loss of information. Now, rather than subject a memory media to erasure of information, there is a move to physically destroy memory media.

While certain types of memory media may be easily destroyed, like flash memory, so called hard drives with rotating memory storage disks may require absolute destruction to help ensure that meaningful data cannot be extracted from the disks. One solution to this problem is to shred the hard drive, but such equipment is expensive, noisy and requires maintenance to ensure proper shredding. Further, such equipment is also not necessarily suited for use in many commercial environments like an office.

Hard drives for personal computers and laptops tend to be of a size and shape that will fit in a bay of predetermined size. The present invention takes advantage of this to provide an apparatus to destroy a hard drive by electrical voltage and physical destruction and adapted for use in many environments, including offices, without the need for a skilled operator.

SUMMARY OF INVENTION

The invention involves the provision of an apparatus for destroying electronic memory media. The apparatus utilizes both compression by crushing plates, and the introduction of electrical current to the crushing plates resulting in mechanical and electrical destruction of the hard drive. The device includes a support assembly to carry a hard drive apparatus and tie other components together. A linearly movable member is coupled to a control system to selectively control movement of a hydraulic cylinder with a movable ram. A first insulated plate is mounted on the ram for movement toward a second plate carrying between 5 and 100 volts of AC or DC power. The plates have complimentary exposed surfaces facing generally toward one another. The plate carrying the voltage can be reversed and/or the plates can each carry voltage with alternating voltage impacts. The surface on the movable plate has a cavity defined by the base of protuberances, a second plate is carried by the support assembly and has an exposed second face facing generally toward the first face. The second plate has protuberances projecting therefrom that are sized and shaped to fit within a respective cavity formed in the first plate. A stripper mechanism is carried by the support assembly and is operably associated with the movable first plate such that when the first plate moves away from the second plate, the stripper mechanism has a portion that moves inwardly to engage a portion of a memory device carried by the first plate to effect its release from the first plate.

An objective of the invention is to electrify a compression plate rendering magnetically stored information unretrieveable and unusable.

An objective of the invention is to electrify either a first plate or a second plate, or both plates with alternating strikes of voltage timed toward each plate.

Still another objective of the invention is provide a device with 187 interlocking razor sharp hardened steel teeth placed on facing plates that crush magnetic media with 20 tons of destructive forces to puncture, macerate, distort, and demagnetize the media; destroying all media including circuit boards and memory chips.

What is needed in the art is a compression device that employs an electrical current causing both physical destruction and magnetic destruction of solid-state storage devices.

DETAILED DESCRIPTION OF THE INVENTION

Figure 1:
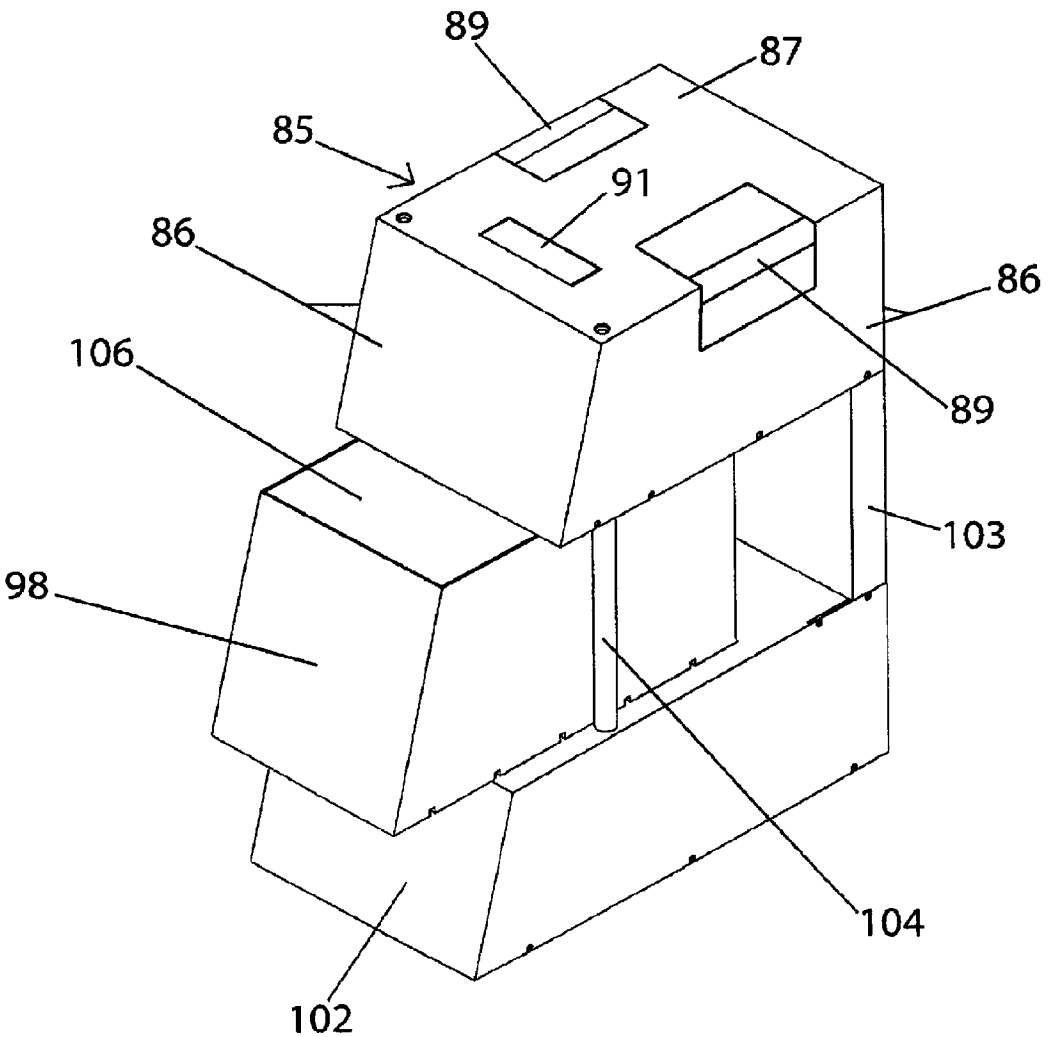
FIG. 1 is a perspective view of an apparatus for crushing memory media showing a hopper in a partially out position.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated.

Referring to the figures in general, disclosed is an apparatus for destroying an electronic memory media device such as a hard drive from a PC or laptop computer. The apparatus includes a compression assembly 3 that is adapted to both compress the memory device 2 and to positively bend it in given areas to ensure fracture of the memory media (not shown) inside the memory device. A typical hard drive has a housing 4 that contains electronic components, a drive motor, data pickups and one or more rotating disks that store digital or analog data. The apparatus 1 includes an enclosure 7 for housing various of the components of the apparatus 1 including the compression assembly 3. The compression or crusher assembly 3 includes a pair of opposed plates 5, 6 with one preferably being fixed and one being movable. The plates 5, 6 are mounted in a support assembly, designated generally 8, which is in turn positioned in the enclosure 7. The support assembly 8 ties components of the compression assembly 3 together. The compression assembly 3 includes a power drive assembly designated generally 10 that has a portion operably coupled to at least one of the plates 5, 6 to effect relative movement therebetween. With a memory device 2 positioned between the plates 5, 6, movement of the plate 5 toward the plate 6 will effect crushing and predetermined bending of the memory device 2 resulting in its destruction.

Figure 3:
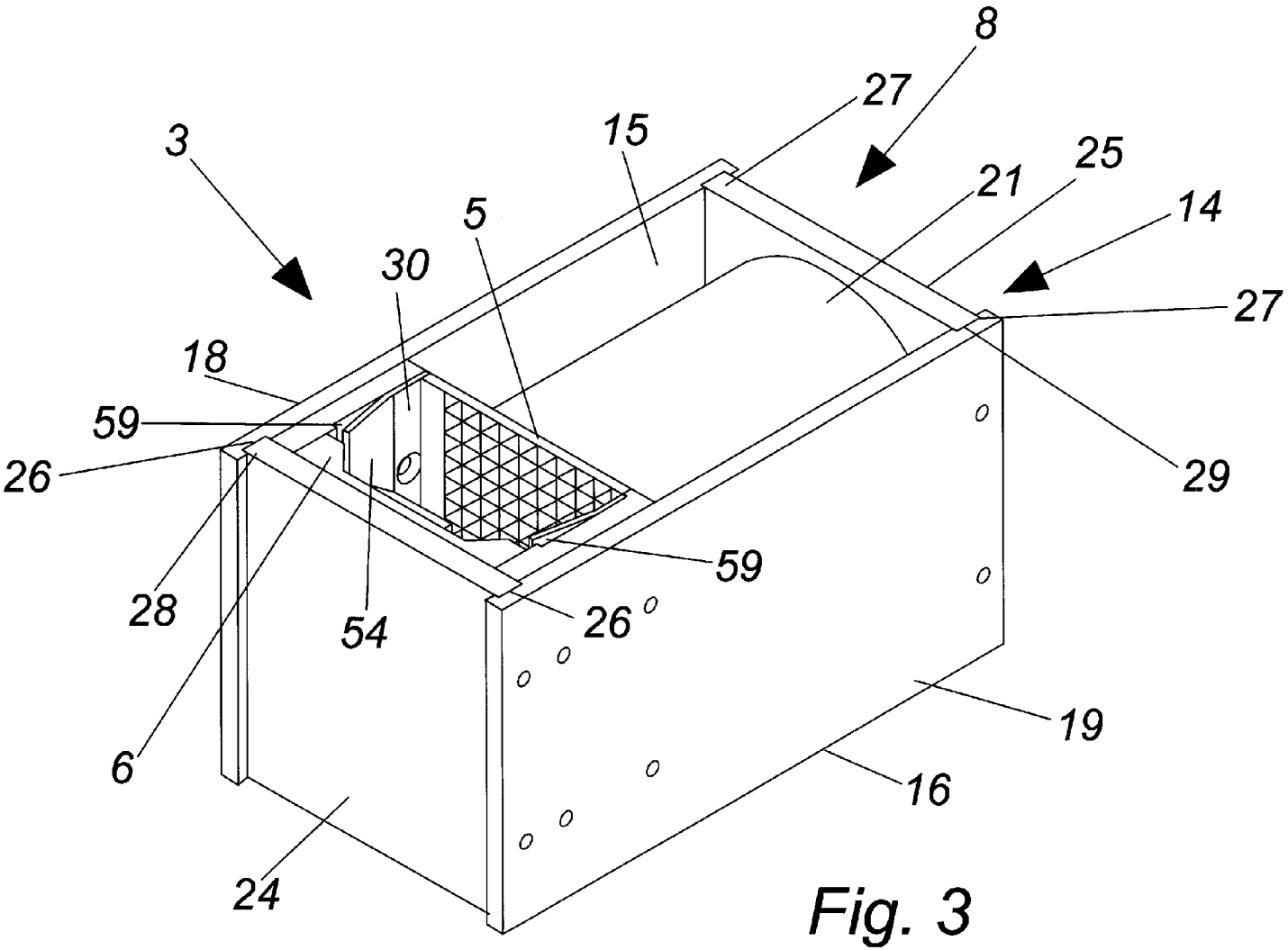
FIG. 3 is an enlarged perspective view of the crusher portion of the apparatus of FIG. 1.
Figure 4A:
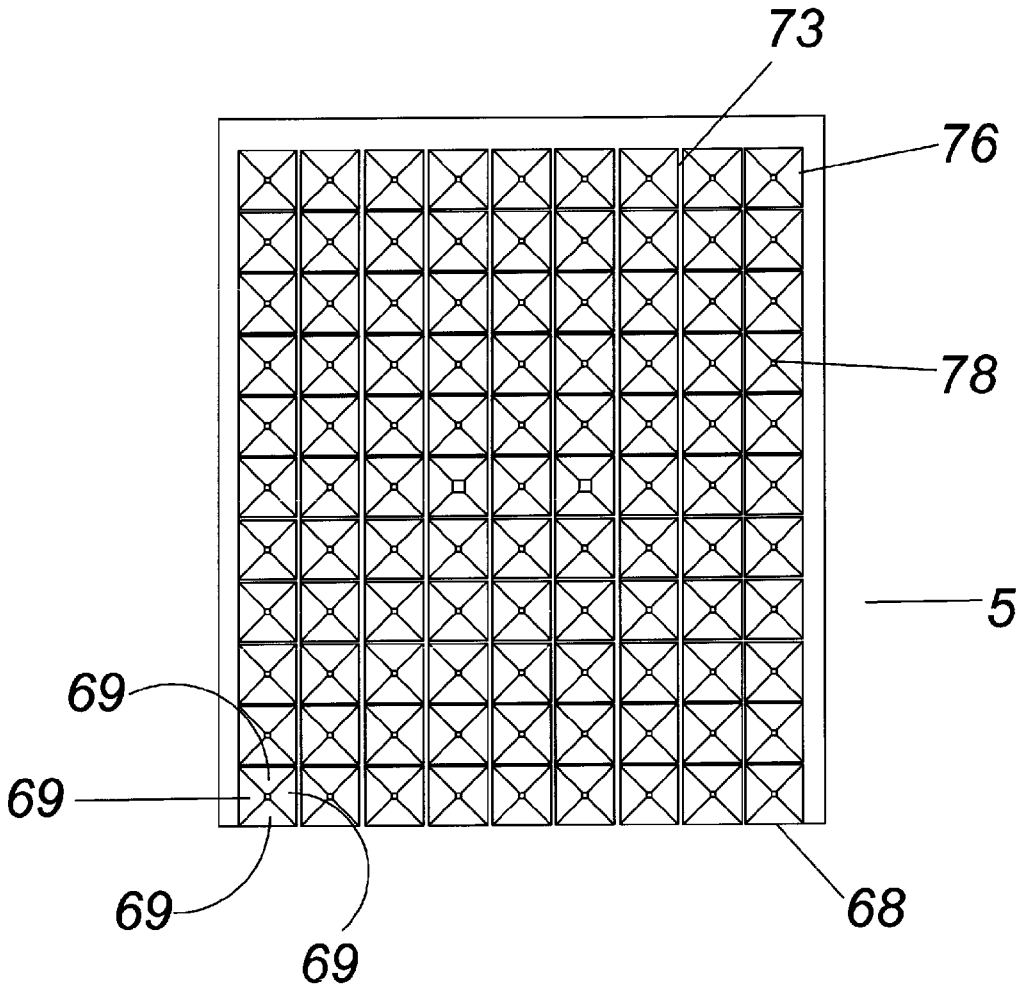
FIG. 4A includes a plan view of a first crusher plate.
Figure 4B:
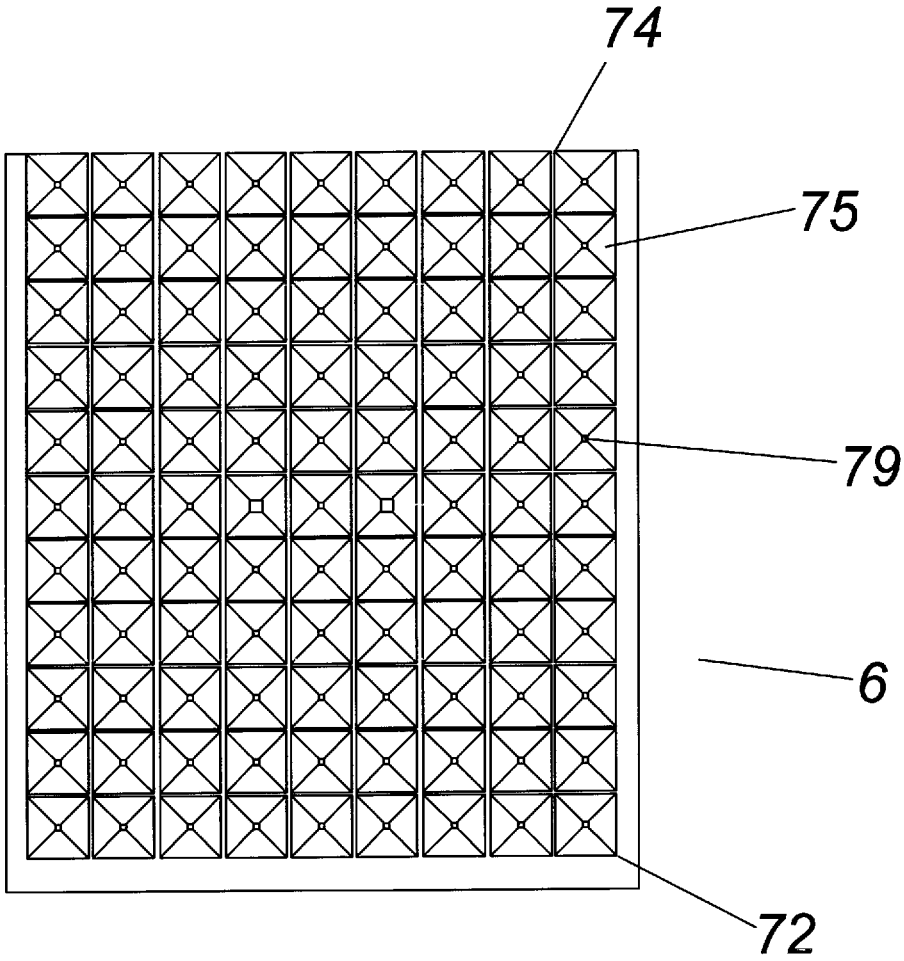
FIG. 4B includes a plan view of a second crusher plate.
Figure 5:
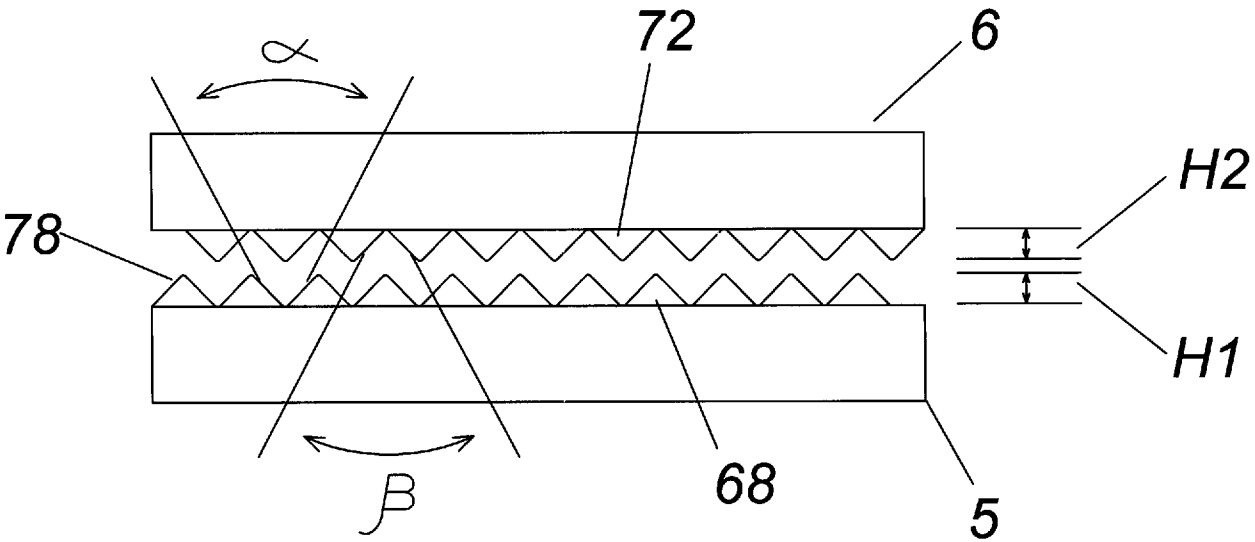
FIG. 5 is a cross sectional side view of the first and second crusher plates.

The support assembly 8 is constructed to tie portions of the compression assembly 3 together so that force can be applied to a memory device 2 for its destruction. In a preferred embodiment, the support assembly 8 fixes the position of plate 6 and allows plate 5 to move toward and away from plate 6. The power drive assembly 10 selectively effects the movement of the plate 5. The support assembly 8 (FIG. 3) carries at least a portion of the power drive assembly 10. In the illustrated structure, the support assembly 8 is in the form of a box 14 having an open side 15 that allows access to the space 16 between the plates 5, 6 when they are in an open position. The box 14 includes tie members such as side tie walls 18, 19. End walls 24, 25 are also provided for the box 14 and generally close opposite ends of the box 14 and provide support for the plate 6 and for portions of the power drive assembly 10. The walls 24, 25 are secured to the walls 18, 19 in any suitable manner such as with mechanical fasteners such as bolts or rivets or permanently as by welding. As shown, edge margin portions 26, 27 of the walls 24, 25 are received in grooves 28, 29 in the inside faces of the walls 18, 19 to assist in assembly of the box 14 and resist shearing load between the walls 18, 19 and the walls 24, 25. Preferably, the walls 18, 19, 24, 25 are made of steel or other suitable metal alloy. In a preferred embodiment, the box has opposing open sides 15 for a purpose later described.

The power drive assembly 10 is operable to selectively effect relative movement between the plates 5, 6 and apply force to a memory device 2 therebetween. In a preferred embodiment, only the plate 5 will move while plate 6 remains stationary in the support assembly 8. As shown, the power drive assembly 10 includes a linear motion device, such as a double acting hydraulic cylinder 21. The plate 5 is mounted to a distal end portion of the piston rod or ram 22 and is movable thereby. The hydraulic cylinder 21 is mounted on the end wall 24 and is preferably positioned inside the box 14. The length of stroke of the hydraulic cylinder 21 is preferably such as to positively limit movement of the plate 5 between side stripper or ejector mounts 30, as described below, by bottoming out while moving between the ejector mounts 30 upon extension and contraction. Movement of the plate 5 is limited laterally and rotationally by the ejector mounts 30.

Figure 6:
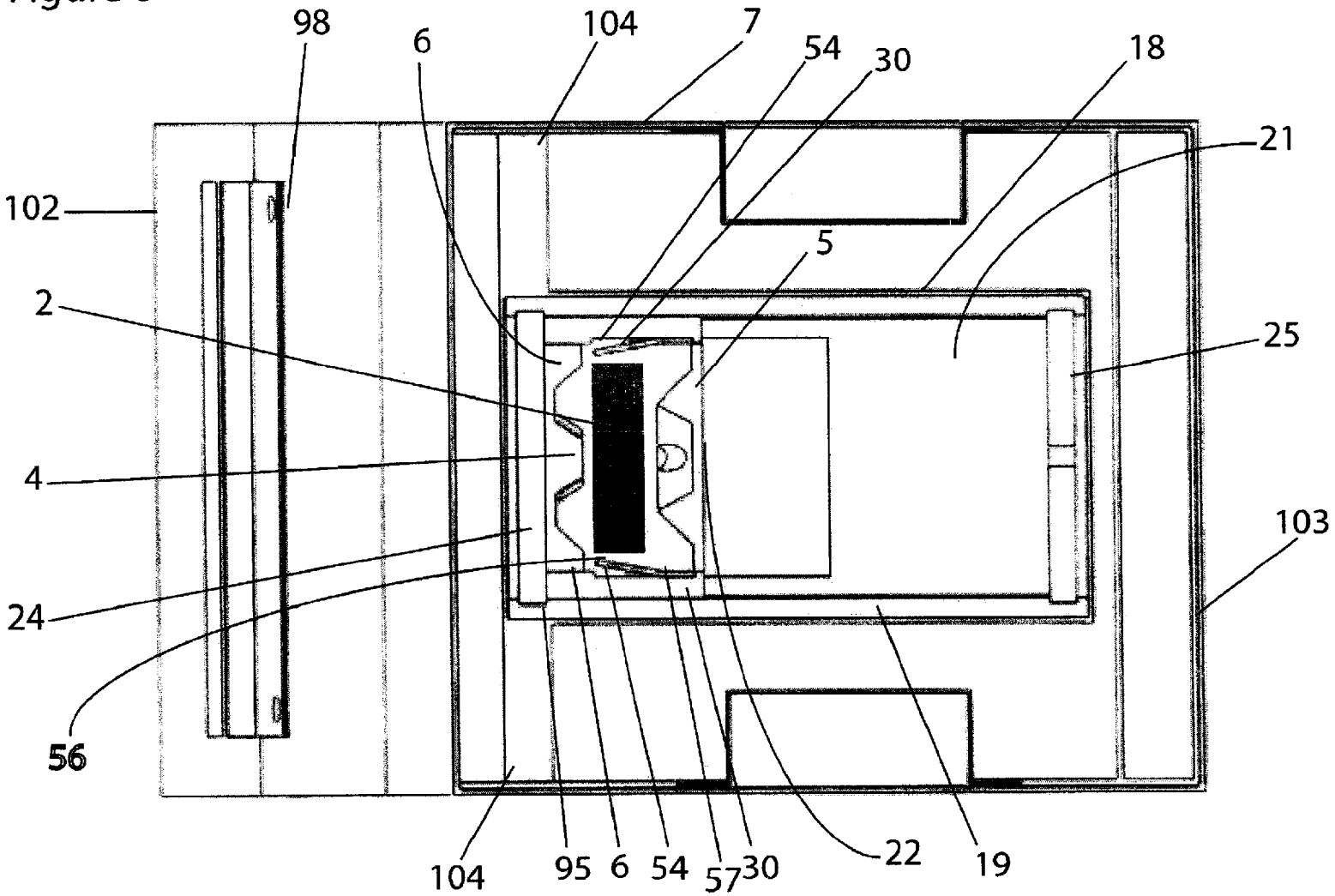
FIG. 6 is a cross sectional plan view with a portion of the cover removed to show the disk compression assembly.
Figure 7:
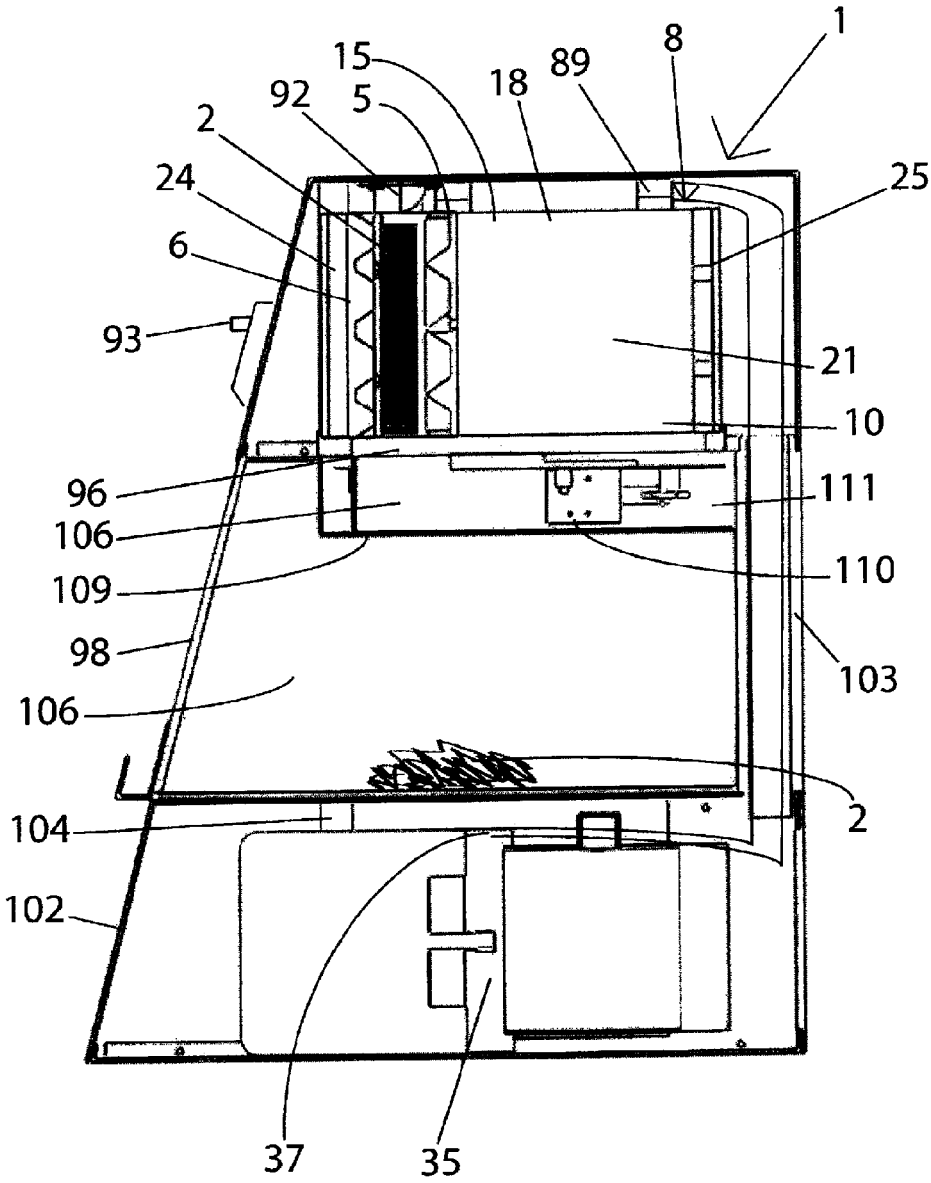
FIG. 7 is a fragmentary side view with side walls removed to show the interior of the apparatus of FIG. 1.
Figure 8:
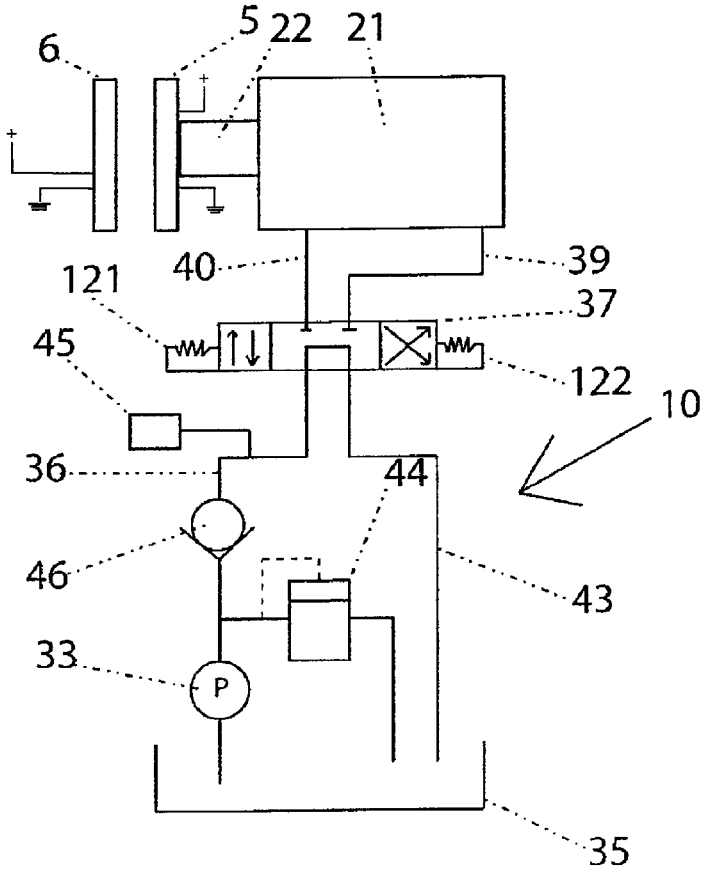
FIG. 8 is a schematic view of a hydraulic and control system.
Figure 9:
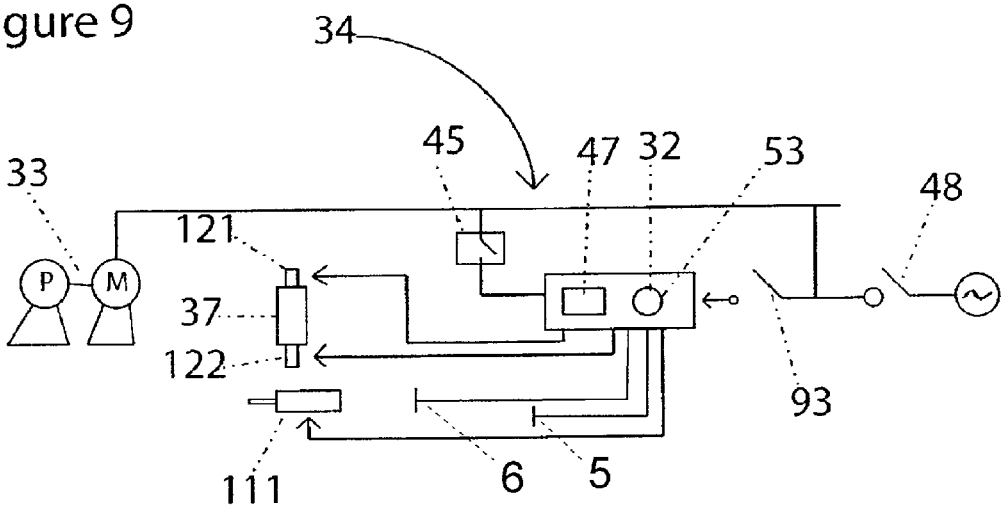
FIG. 9 is a simplified schematic of the electrical control circuit.

FIG. 6 shows one form of power and control circuit portion of the drive assembly 8 for providing pressurized hydraulic fluid to the hydraulic cylinder 21. Preferably, the hydraulic lines, pump and control valves are contained inside a base enclosure while the operator controls, designated generally 32, are mounted to the outside of the box 14 on the exterior of a cover housing 85 described below. The operator controls 32 are part of a controller circuit 34 described below. The hydraulics include a pump system 33 including a pump "P" and motor "M". The pump system 33 is operable to provide pressurized fluid from a fluid reservoir 35 to the hydraulic cylinder 21. Hydraulic fluid can flow to and from the reservoir 35 during extension and retraction of the hydraulic cylinder 21. A conduit 36 connects the outlet of the pump "P" to a valve 37 of the control circuit 34. The valve 37 may be a solenoid operated three position spool valve which selects whether pressurized fluid is fed to the hydraulic cylinder 21 on the piston side through conduit 39 to extend the ram 22 or to the rod side through conduit 40 to retract the ram 22. Preferably the valve 37 is a spring return valve that allows the pump "P" to exhaust fluid to the reservoir 35 when the hydraulic cylinder is not being extended or retracted. Exhausted hydraulic fluid from the hydraulic cylinder 21 is returned to the reservoir 35 via conduit 43. As shown, a pressure switch 45 of the control circuit 34 is operably associated with the conduit 36 to sense fluid pressure therein. Optionally, the pressure switch 45 could be connected to the conduit 39. When a predetermined pressure is sensed in conduit 36, the switch 45 provides a signal to a valve controller 47 portion of the control circuit 34. The hydraulic system may also be provided with a pressure relief valve 44 connected to the conduit 36 and operable to effect discharge to the reservoir 35. A check valve 46 may also be provided in the conduit 36 to prevent reverse flow. As shown, the valve controller 47 includes a timer and relay switch. An operator control switch 53 is provided and when activated, the valve 37 is shifted to a position to feed pressurized fluid to the piston side of the hydraulic cylinder to effects its extension. After effecting start, the hydraulic cylinder 21 may be operated automatically to extend and retract. A separate main power switch 48 may be provided to effect power on/off to the control circuit 34. As shown, the main power switch 48 can power the motor "M" on/off independent of operation of the state of the other control devices. The motor "M" could be powered on/off by the operator controller 32.

While the power drive assembly 10 is illustrated and described as using a double acting hydraulic cylinder, it is to be understood that other drives can be used utilizing a linear moving drive device. For example, a toggle system could be used, an air powered system or an electric motor and screw could be used as linear actuators.

Figure 2:
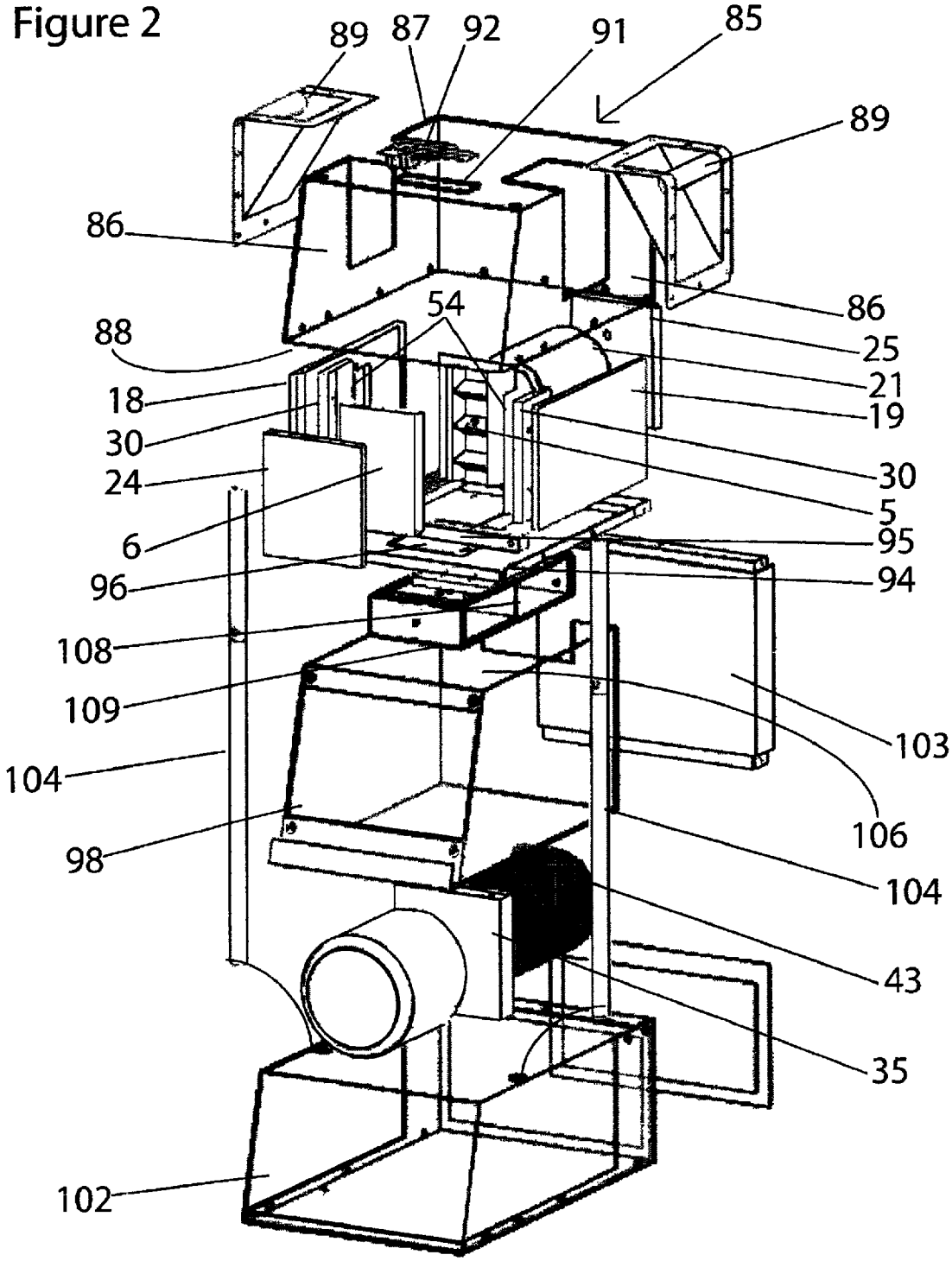
FIG. 2 is an exploded perspective view of the apparatus of FIG. 1.

The compression assembly 3 is shown as including the plates 5, 6, with one being movable and one being fixed. It also includes the stripper mounts 30 (FIGS. 2, 3, 6) and one or more stripper mechanisms 54 carried by the support assembly. The stripper mechanisms 54 are operably associated with the plate 5 whereby when the plate 5 moves thereby during movement away from the plate 6, the stripper mechanisms 54 each have portion movable inwardly to engage a portion of a memory device 2 carried by the plate 5 and release a memory device 2 from the plate 5. Preferably the stripper mechanisms 54 automatically operates to strip or eject a retained memory device 2 from retention on the plate 5. The stripper mechanisms 54 also limits lateral and rotational movement of the plate 5. As described, in a preferred embodiment of the invention, the movable plate 5 is configured to retain a crushed memory device 2 thereon in preference to retention on the plate 6 as described below. However, it is to be understood that the plate 6 could be configured to preferentially retain a crushed memory device 2. The stripper mechanism 54 will automatically strip a destroyed memory device 2, if retained, upon opening movement of the plate 5.

Preferably there is a stripper mechanism 54 on each of opposite side edges of the plate 5, preferably the plate sides extending between the open sides 15 of the box 14. As shown, a stripper mechanism 54 is mounted to a respective mount 30 in a removable manner as with mechanical fasteners such as a bolts or cap screws with their heads each in a recess in the mount 30. A stripper mechanism 54 is in the form of a plate having a movable distal portion 56 and a proximal mount portion 57. The distal portion 56 lies in a plane at an angle to the plane of the mount portion 57 preferably at an angle in the range of between about 5° and about 30° depending on the height H of the distal portion. The stripper mechanism 54 is made of a resiliently deformable material such as spring steel. The distal portion 56 can move into and out of a recess 59 in the mount 30 to provide clearance for movement of the plate 5 by the stripper mechanism 54. When the plate 5 moves toward a closed position by the stripper distal portion 56, the distal portion 56 engages a respective side edge of the plate 5 and resiliently moves outwardly. Upon the plate 5 moving towards an open position, the distal portion 56 moves inwardly to engage a crushed memory device 2 to strip it from retention on the plate 5 if it is retained thereon. The height "H" of the distal portion 56 is such as to provide enough inward movement to engage a retained memory device 2 and push it off during opening movement of the plate 5. Having a stripper mechanism 54 on opposite sides helps ensure stripping engagement. The stroke length of the hydraulic cylinder 21 and the position of the plate 6 relative to the strippers mechanism 54 ensures that a top edge of the plate 5 does not go past the free edge of a distal portion 56.

The plates 5, 6 are preferably configured on the plates that generally face one another for crushing and bending a memory device 2. The first plate 5 is insulated and grounded, while mounted to a member and movable therewith having an exposed first face with at least one outwardly opening cavity formed at the base of the protuberances.

A second insulated and electrically charged plate 6 is carried by the support assembly 8 and has an exposed second face facing generally toward the first face. The second plate has protuberance projecting therefrom and sized and shaped to fit within a respective said first cavities formed in the first plate 5.

The plates are configured to provide positive predetermined bending of portions of a memory device 2 during crushing between the plates 5, 6. In addition, the contours on the faces 5, 6, are such as to bias retention of a device 2 on plate 5 to assist in stripping, should a crushed device 2 adhere to a plate. The plate 5 is provided with one or more protuberances 68 (male projections) projecting toward the plate 5. As shown, the protuberances 68 are generally pyramidal having four side surfaces 69 forming a square base in transverse cross section at least at their outer extremities. As shown, there is a single row of protuberances 68 separated by corresponding cavity 73 for each protuberance 68 to be received in during closing movement of the plate 5. It is preferred that the cavities 73 be generally similar in cross sectional shape to forming a mirror image of second plate 6 protuberances 72.

As shown, the plate 6 includes a plurality of cavities formed by being positioned directly across from the protuberances 68. The height H1 0.238 inches of protuberances 68 corresponds to the approximate height H2 0.238 inches of the protuberances 72. The angle of incline of the surfaces 75 along with the heights H1, H2 are chosen to ensure reliable predetermined bending of the data storage member inside the device 2. The angle of incline $\alpha$ from perpendicular is preferably about 45° and the angle $\beta$ of the surfaces 69 is preferably about 45°. An apex 79 is positionable between opposite surfaces. It is preferred that the apexes have a width of less than about 0.25 cm and more preferably, the ribs are V-shaped with a relatively sharp apex. The angle $\alpha$ and the height H1 are chosen relative to the shape of the protuberances 68, 72 to bias retention of a compressed memory device 2 on the plate 5 for stripping by the stripper mechanisms 54.

The second insulated plate is electrically charged to a higher voltage than the breakdown voltage of a device cell structure. In the preferred embodiment the insulated plate is charged from 5 to 100 volts with either direct current (DC) or alternating current (AC). The first insulated plate has protuberances interfacing with the second insulated plate protuberances. In the preferred embodiment the first insulated plate has about 88 protuberances and said second insulated plate has about 99 protuberances. Effectively there are 187 protuberances in the preferred embodiment. It is noted that the first insulated plate may employ the 99 protuberances and the second insulated plate having the 88 protuberances without affecting the preferred embodiment. It is also noted that the amount of protuberances and vary based upon the size of the solid state storage device to be destroyed, the preferred embodiment being the most universal size for most solid state storage devices currently on the market.

The apparatus 1 includes the enclosure 7. The enclosure 7 includes a top housing 85 that encloses the compression assembly 3 and at least portions of the power drive assembly 10. It has side and top wall 86, 87 respectively and has an open bottom 88 to permit removal from the enclosure. The housing 85 also has handles 89 to assist in moving the apparatus and removal of the top housing 85. The housing 85 is also provided with a feed opening 91 through the wall 87 adjacent the space between plates 5, 6 along an open side. In use, a memory device 2 can be fed into the apparatus through the feed opening for processing. The housing 85 shields the components therein from accidental contact and from any accidental discharge of a part of the memory device 2 from ejection during compression. An entry door 92 (FIG. 2) is provided at the feed opening 91 and mounted to the housing 85 for movement to selectively close the feed opening 91. An interlock switch 93 may also be mounted to the housing 85 to cooperate with the entry door 92 and provide a signal that the entry door 92 is in an open or closed position and if open to at least prevent or stop the hydraulic cylinder 21 from moving to an extended position. The interlock switch 93 may also be used to shut down the whole control circuit 34. The housing 85 has a bottom wall 94 at its open bottom 88. A mount 95 may be secured thereto for securing the compression assembly 3 in place. A discharge opening 96 forms a discharge path for a crushed memory device 2 to pass through into a discharge hopper 98 located below the wall 94 and the plates 5, 6. The discharge hopper 98 is located above a riser housing 102 that rests on a floor or elevated work surface. In the illustrated structure, the housing 102 is tied to the housing 85 and mount 95 via tie rods 104. The hydraulic system, including pump "P", motor "M", reservoir 35 and the valves 37, 44, 46 may be housed in the housing 102 and the conduits 39, 40 may extend through a duct 103 to the hydraulic cylinder 21 in the housing 85. The hopper 98 is movable relative to the housings 85, 102 and has an open top to allow access to an interior storage chamber 106 to remove crushed memory devices 2 therefrom.

The apparatus 1 is provided with means to allow the selective discharge of a crushed memory device 2 from a location between plates 5, 6 to the storage chamber 106 in discharge hopper 98. The discharge hopper 98 slidably rests on the riser 102 and may be moved outwardly to expose the chamber 106 for removal of crushed memory drives 2 or removed to dump out crushed memory drives 2. A gate 108 is movably mounted adjacent the opening 96 and is operable to selectively close and open the opening 96 and function as a trap door. The gate 108 is positioned on the bottom side of the wall 94. The gate 108 is in a closed position when the plates 5, 6 are in the open position and ready to receive a memory device 2 therebetween for crushing. When the plate 5 moves to an open position, the gate 108 can also move to an open position allowing a crushed memory device 2 to pass through opening 96. The gate 108 can be supported by guides 109 secured to the wall 94. The gate 108 is connected to a drive assembly 110 to effect its selective movement to open and close the opening 96. As shown, the drive assembly 110 includes a solenoid 111 operably connected to the control circuit 34 to effect its operation.

The present invention is better understood by a description of its operation. A memory device 2 is placed between the plates 5, 6 by placing through feed opening 91 and past entry door 92. The plates 5, 6 are generally vertically disposed providing a generally vertically disposed passage therebetween. The operator selects manual or automatic mode with control switch 53. The entry door 92 must be closed as indicated by interlock switch 93. The valve 37 is shifted by energizing solenoid 122 to allow the hydraulic cylinder 21 to extend. The plate 5 moves generally horizontally toward the plate 6 with the memory device 2 in the space between the plates 5, 6. Plate 6 is electrified while plate 5 applies force to the memory device 2 from the hydraulic cylinder 21 to effect positive and predetermined bending of portions of the memory device 2 over the protuberances 68, 72 to ensure fracture of the data storage media inside the memory device 2 and to destroy the memory device 2 by compression. The electrical voltage applied through plate 6 is of such a level to disrupt the magnetic media rendering the media unusable. The amount of voltage can be adjusted between 5 and 100 volts, based upon the type of media to be destroyed. The voltage can be directed through either plate, making the other plate a ground. Further, both plates can be electrified by use of alternating strikes of voltage timed toward each plate. In this embodiment, the first plate receives a voltage strike of 5-100 volts while the second plate is grounded. During the compression cycle the second plate can then receive a voltage strike of 5-100 volts while the first plate is grounded. While a single plate voltage spike is deemed sufficient, it is possible that some media disks include a non metal side shell wherein voltage strikes from alternating plates can ensure media destruction.

Retention of a compressed memory device 2 is biased to the plate 5 and if retained, the stripper mechanism 54 automatically releases a compressed memory device from retention on plate 5 upon moving the plates 5, 6 apart during opening movement. When a predetermined pressure is reached, as indicated by the pressure switch 45, a signal is sent to a timer in valve controller 47 and once a predetermined amount of time expires, a signal is sent to solenoid 121 of valve 37 to effect retraction of the hydraulic cylinder 21. After full retraction, the valve 37 can return to neutral by having both solenoids 121, 122 de-energized. The solenoid 111 is then energized to open the gate 108 to open and let a crushed memory device 2 to fall into discharge hopper 98. The apparatus may be operated in an automatic mode by selection of that mode with control switch 53. In automatic mode, the control switch 93 will activate the crush cycle by dropping a memory device 2 through the entry door 92. The entry door 92 must be closed before the hydraulic cylinder 21 can extend. The apparatus then functions as described above. A drive actuator (not shown) may be used to open and close the entry door 92 if desired and can operate via a time delay relay switch.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. An apparatus for destroying electronic memory media having a cell structure, said apparatus including a support assembly, a drive apparatus carried by the support assembly having a linearly movable ram and a control system operably coupled to the drive apparatus and operable to selectively control movement of the ram, said improvement comprising:

a first insulated and grounded plate mounted to an end of the ram and movable therewith and having an exposed first face with a plurality of pyramid shaped protuberances and reciprocal cavities formed therebetween;

a second insulated and electrically charged plate carried by the support assembly and having an exposed second face facing generally toward the first face, said second plate having a plurality of second face protuberances projecting therefrom with reciprocal cavities formed therebetween, said first face protuberances sized and shaped to fit within said second face reciprocal cavities, said second face protuberances sized and shaped to fit within said first face reciprocal cavities, said second plate electrically charged with an applied voltage higher than a breakdown voltage of an electronic memory media cell structure;

a stripper mechanism carried by the support assembly and operably associated with the first plate whereby when the first plate moves away from the second plate the stripper mechanism having a portion movable inwardly to engage a portion of a memory device carried by the first plate and release the memory device from the first plate, said stripper mechanism includes a stripper plate carried by the support assembly, said stripper plate having a distal portion engaging the first plate and movable by said first plate to a retracted position during movement of the first plate toward the second plate and movable toward an extended position during movement of the first plate away from the second plate.

2. The apparatus of claim 1 wherein said applied voltage is between 5 to 100 volts.

3. The apparatus of claim 2 wherein said applied voltage is direct current ("DC").

4. The apparatus of claim 2 wherein said applied voltage is alternating current ("AC").

5. The apparatus of claim 1 wherein said first insulated plate plurality of protuberances is further defined as about 88 protuberances each having a square base with four side walls forming an angle of incline of about 45 degrees for each wall extending from the base to an apex, said first plate protuberances interfacing with said second plate reciprocal cavities.

6. The apparatus of claim 5 wherein each said second plate reciprocal cavity has a depth of about 0.238 inches.

7. The apparatus of claim 5 wherein a height of each said first plate protuberance is about 0.238 inches from the base to the apex and the apex has a width of less than about 0.25 cm.

8. The apparatus of claim 1 wherein said second insulated plate has about 99 pyramid shaped protuberances, each said second plate protuberance having a square base with four side walls forming an angle of incline of about 45 degrees for each wall extending from the base to an apex, said first plate including a plurality of cavities constructed and arranged to interface with said second plate protuberances.

9. The apparatus of claim 8 wherein each said first plate reciprocal cavity has a depth of about 0.238 inches.

10. The apparatus of claim 8 wherein a height of each said second plate protuberance is about 0.238 inches from the base to the apex and the apex has a width of less than about 0.25 cm.

11. The apparatus of claim 1 wherein said second insulated plate receives alternating voltage impacts.

* * * * *